US010968060B2

(12) United States Patent
Oguchi et al.

(10) Patent No.: US 10,968,060 B2
(45) Date of Patent: Apr. 6, 2021

(54) SHEET CASSETTE

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 202 days.

(21) Appl. No.: 16/373,866

(22) Filed: Apr. 3, 2019

(65) Prior Publication Data

US 2019/0308831 A1 Oct. 10, 2019

(30) Foreign Application Priority Data

Apr. 9, 2018 (JP) ..... JP2018-074849

(51) Int. Cl.

| | |
|---|---|
| ***B65H 1/26*** | (2006.01) |
| ***B65H 3/06*** | (2006.01) |
| ***B65H 1/04*** | (2006.01) |
| ***B65H 1/06*** | (2006.01) |
| ***B41J 13/03*** | (2006.01) |

(Continued)

(52) U.S. Cl.

CPC ..... *B65H 3/0669* (2013.01); *B41J 3/36* (2013.01); *B41J 13/0009* (2013.01); *B41J 13/03* (2013.01); *B65H 1/04* (2013.01); *B65H 1/06* (2013.01); *B65H 1/12* (2013.01); *B65H 1/266* (2013.01); *B65H 3/063* (2013.01); *B65H 2402/41* (2013.01); *B65H 2403/722* (2013.01); *B65H 2405/313* (2013.01)

(58) Field of Classification Search

CPC ..... B65H 3/0669; B65H 3/063; B65H 3/06; B65H 1/266; B65H 1/04; B65H 1/06; B65H 2405/313; B65H 2402/41; B65H 2403/722; B65H 2403/42; B41J 3/36

See application file for complete search history.

(56) References Cited

U.S. PATENT DOCUMENTS

| | | | | |
|---|---|---|---|---|
| 7,536,129 | B2 | 5/2009 | Lee et al. | |
| 2003/0223801 | A1 * | 12/2003 | Jang | B41J 13/103 400/718 |

(Continued)

FOREIGN PATENT DOCUMENTS

| | | | |
|---|---|---|---|
| JP | 07109041 | A * | 4/1995 |
| JP | H09-77283 | | 3/1997 |

(Continued)

*Primary Examiner* — Luis A Gonzalez

(74) *Attorney, Agent, or Firm* — IPUSA, PLLC

(57) ABSTRACT

A sheet cassette that accommodates a recording sheet and is connected with a printer includes a first roller contacting a feed roller of the printer, a second roller contacting a recording sheet, a first gear and a second gear attached to a shaft of the first roller, a third gear and a fourth gear attached to a single shaft, and a fifth gear attached to a shaft of the second roller, wherein the first gear independently rotates relative to the first roller and the second gear, the feed gear of the printer engages with the first gear, the first gear engages with the third gear, the fourth gear rotates together with the third gear, the fourth gear engages with the fifth gear, and the second roller is rotated by rotation of the fifth gear.

6 Claims, 12 Drawing Sheets

(51) Int. Cl.

| | |
|---|---|
| ***B41J 13/00*** | (2006.01) |
| ***B65H 1/12*** | (2006.01) |
| ***B41J 3/36*** | (2006.01) |

(56) References Cited

U.S. PATENT DOCUMENTS

| | | | | |
|---|---|---|---|---|
| 2004/0109056 | A1 | 6/2004 | Kang | |
| 2009/0052967 | A1* | 2/2009 | Cook | B41J 3/36 400/578 |
| 2013/0221604 | A1 | 8/2013 | Matsushima et al. | |
| 2014/0042687 | A1* | 2/2014 | Taoka | B65H 1/266 271/9.01 |
| 2018/0281481 | A1 | 10/2018 | Yamaya | |

FOREIGN PATENT DOCUMENTS

| | | | | | |
|---|---|---|---|---|---|
| JP | 2003276889 | A | * | 10/2003 | |
| JP | 2004-345819 | | | 12/2004 | |
| JP | 2006-159427 | | | 6/2006 | |
| JP | 2012082041 | A | * | 4/2012 | G03G 15/6508 |
| JP | 2017178486 | A | * | 10/2017 | B65H 3/0669 |

* cited by examiner

SHEET CASSETTE

CROSS-REFERENCE TO RELATED APPLICATIONS

This patent application is based upon and claims the benefit of priority of Japanese Patent Application No. 2018-074849 filed on Apr. 9, 2018, the entire contents of which are incorporated herein by reference.

BACKGROUND OF THE INVENTION

1. Field of the Invention

The present invention relates to a sheet cassette.

2. Description of the Related Art

Conventionally, a portable printer is shaped like a box, relatively large, and needs to be put into a bag for carrying. However, the portable printer is preferably small, light, and easy to carry around. A sheet cassette into which recording sheets (hereinafter, referred to as "sheet(s)") are accommodated may be used with the portable printer.

[Patent Document 1] Japanese Laid-open Patent Publication No. 2006-159427

[Patent Document 2] Japanese Laid-open Patent Publication No. 2004-345819

SUMMARY OF THE INVENTION

When the sheet cassette is connected with the portable printer, the sheet accommodated in the sheet cassette is supplied to the printer, and a convey mechanism for conveying the sheet is necessary. However, when the convey mechanism is provided to the portable printer, the portable printer becomes large.

According to an embodiment of the present invention, there is provided a sheet cassette that accommodates a sheet and is connectable to a printer includes a first roller contacting a feed roller of the printer, a second roller contacting a sheet, a first gear and a second gear attached to a shaft of the first roller, a third gear and a fourth gear attached to a single shaft, and a fifth gear attached to a shaft of the second roller, wherein the first gear independently rotates relative to the first roller and the second gear, the feed gear of the printer engages with the first gear, the first gear engages with the third gear, the fourth gear rotates together with the third gear, the fourth gear engages with the fifth gear, and the second roller is rotated by rotation of the fifth gear.

DETAILED DESCRIPTION OF EMBODIMENTS

A description of embodiments of the present invention is given with reference to the FIG. 1 through FIG. 21.

The same reference symbols are attached to the same portions or the like and the description of these portions are omitted. Within embodiments of the present invention, an X direction, a Y direction, and a Z1 direction are mutually orthogonal.

(Printer)

Figure 1:
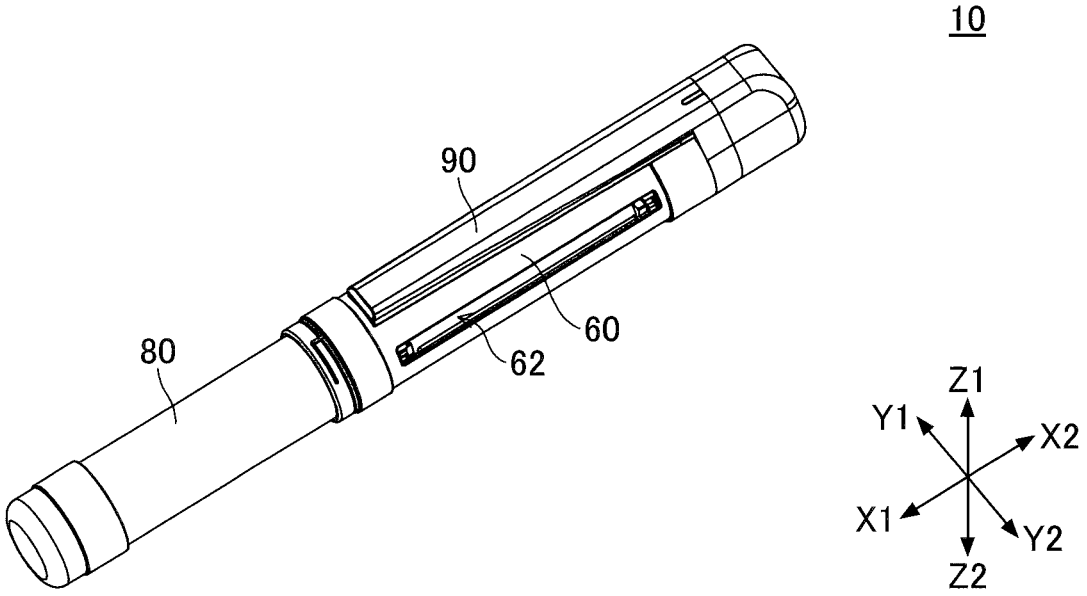
FIG. 1 is a perspective view of a printer.
Figure 2:
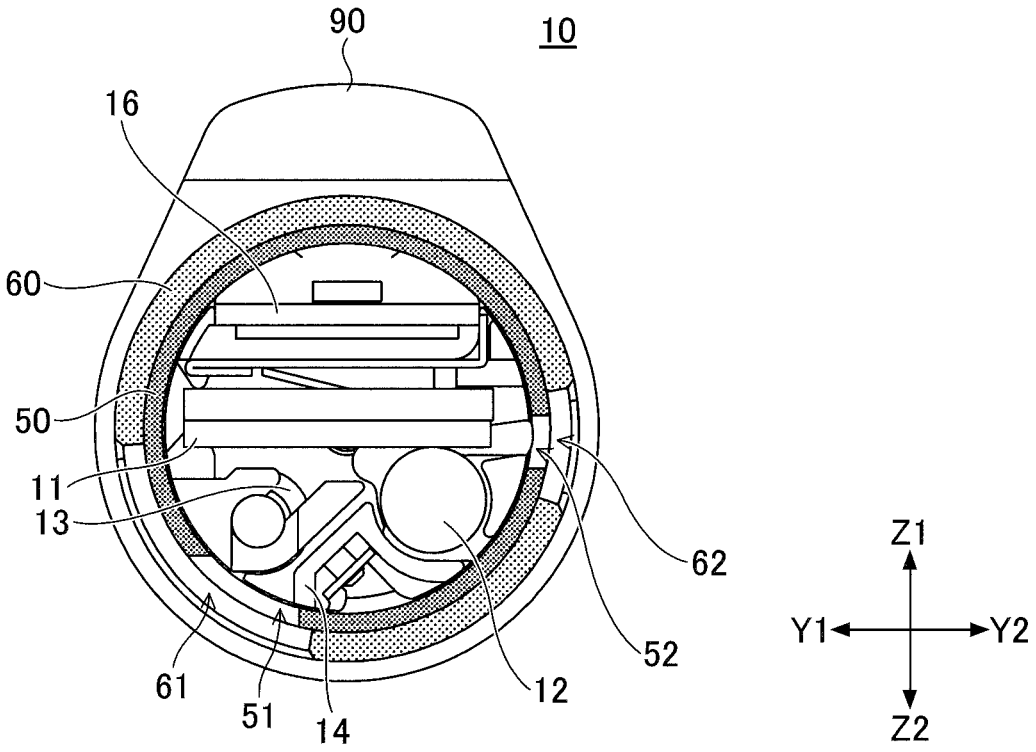
FIG. 2 is a cross-sectional view of the printer.

A portable printer 10 to which a sheet cassette of an embodiment can be attached is described. The printer 10 is formed to be a columnar pen type and called a pen type printer. FIG. 1 is a perspective view of the printer 10. FIG. 2 is a cross-sectional view of the printer 10. The printer 10 is an Internet of Things (IoT) device, which is provided with a printer function and a wireless communication function.

The printer 10 includes a printer head 11 such as a thermal head, a platen roller 12, a feed roller 13, a sheet guide 14, a spring, control board 16, an inner cover 50, and an outer cover 60. The printer head 11 is pushed against the platen roller 12 by the spring. The sheet is brought into the printer 10 along a sheet guide 14 from a side where the feed roller 13 is installed. The sheet is conveyed, printed, and ejected in a state where the sheet is interposed between the printer head 11 and the platen roller 12. An electronic circuit and electronic parts control the printer 10 and are installed in the control board 16.

The inner cover 50 and the outer cover 60 are in a cylindrical shape. The inner cover 50 is inserted into the outer cover 60. A feed port 51 and an ejection port 52 are formed on the inner cover 50 so as to open along a generating line of the inner cover 50. A feed port 61 and an ejection port 62 are formed on the outer cover 60 so as to open along a generating line of the outer cover 60. The outer cover 60 is rotatable relative to the inner cover 50.

When the printer 10 prints, the positions of the feed port 51 and the feed port 61 match so that the feed port 51 opens through the feed port 61, and the positions of the ejection port 52 and the ejection port 62 match so that the ejection port 52 opens through the ejection port 62. The sheet is fed into the opened feed port 51 and the feed port 61 and ejected from the opened ejection port 52 and the ejection port 62. A sheet cassette 100 may be connected with the printer 10 through the feed port 61 in a state where the feed port 51 opens through the feed port 61.

When the printer 10 prints print data, the print data is transmitted from an information terminal (not illustrated) to the printer 10 by wireless communications such as Bluetooth Low Energy (BTL). Therefore, an antenna for wireless communications is built inside the printer 10.

The printer 10 includes a power supply unit 80, in which a lithium-ion battery that is a rechargeable battery is installed. The printer 10 can be driven by electric power supplied by the lithium-ion battery. A connector (not illustrated) for charging the rechargeable battery is built in the printer 10.

The printer 10 has a diameter of about 18 mm and a length of about 165 to 170 mm. Thus, the printer 10 is small enough to carry without stress. The printer 10 has a hook 90, by which the printer 10 can be hung on and carried in a pocket of the chest in a manner similar to a pen.

(Sheet Cassette)

Figure 3:
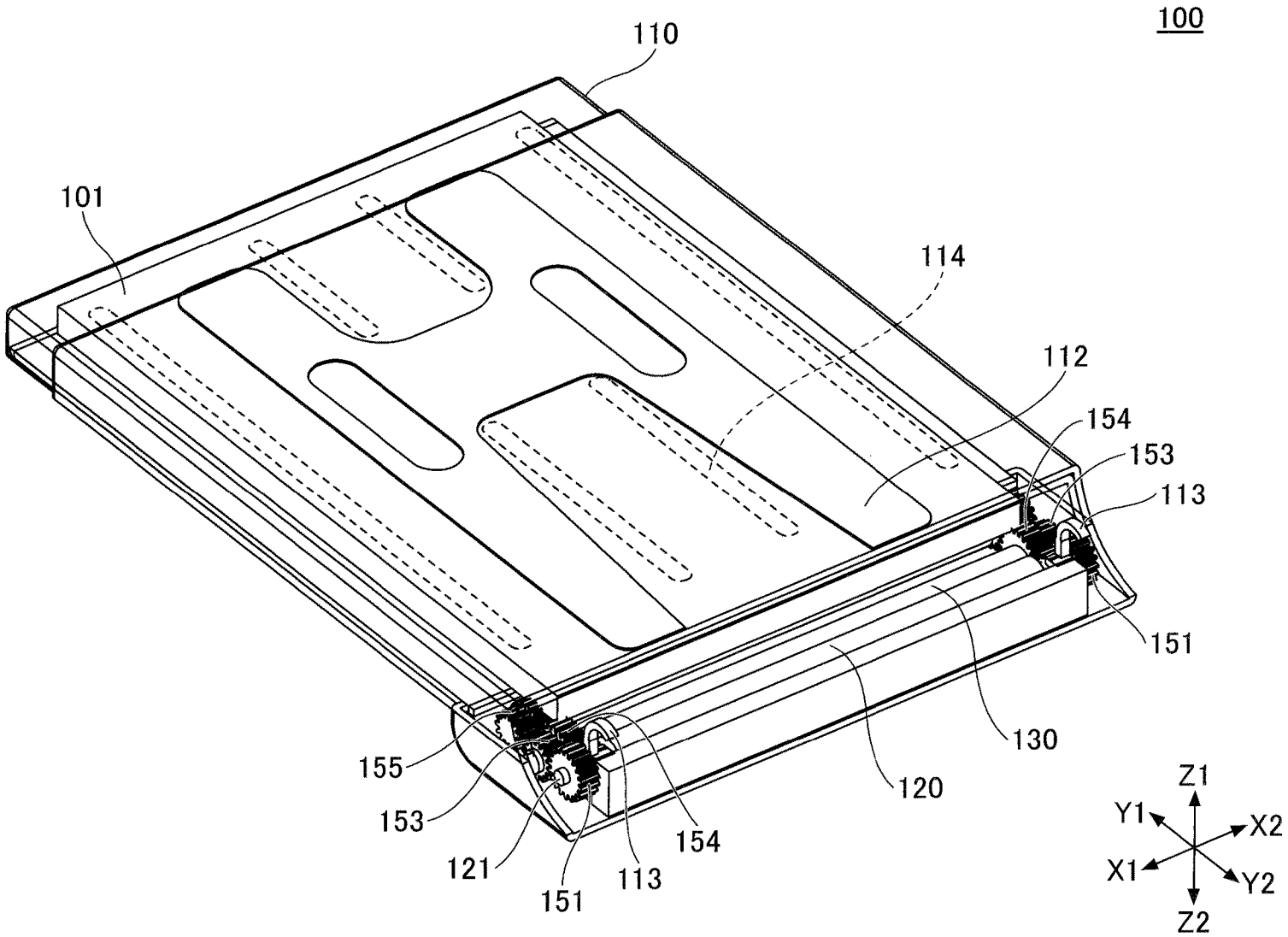
FIG. 3 is an upper partly-transparent perspective view of a sheet cassette of an embodiment.
Figure 4:
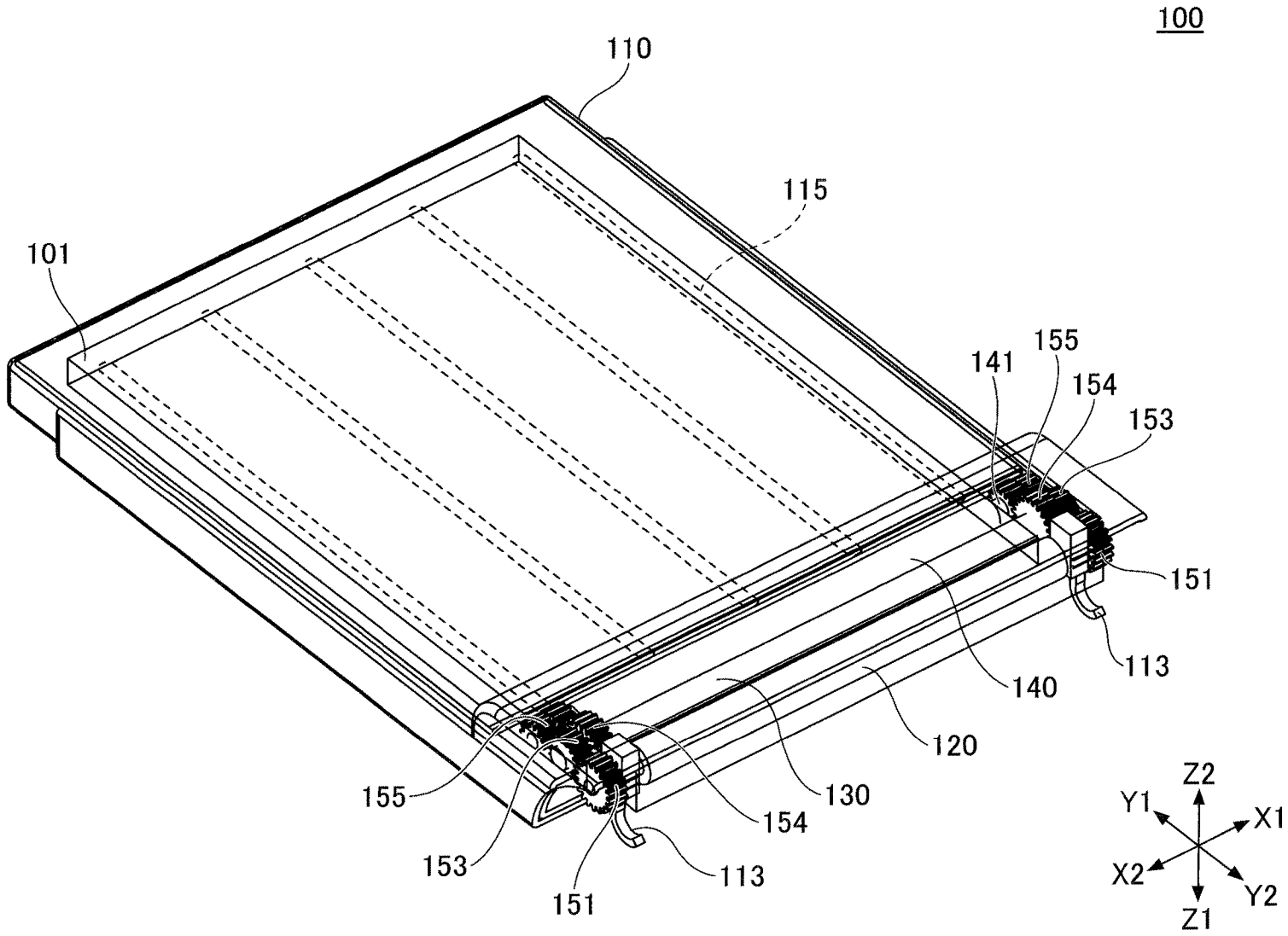
FIG. 4 is a bottom partly-transparent perspective view of the sheet cassette.
Figure 5:
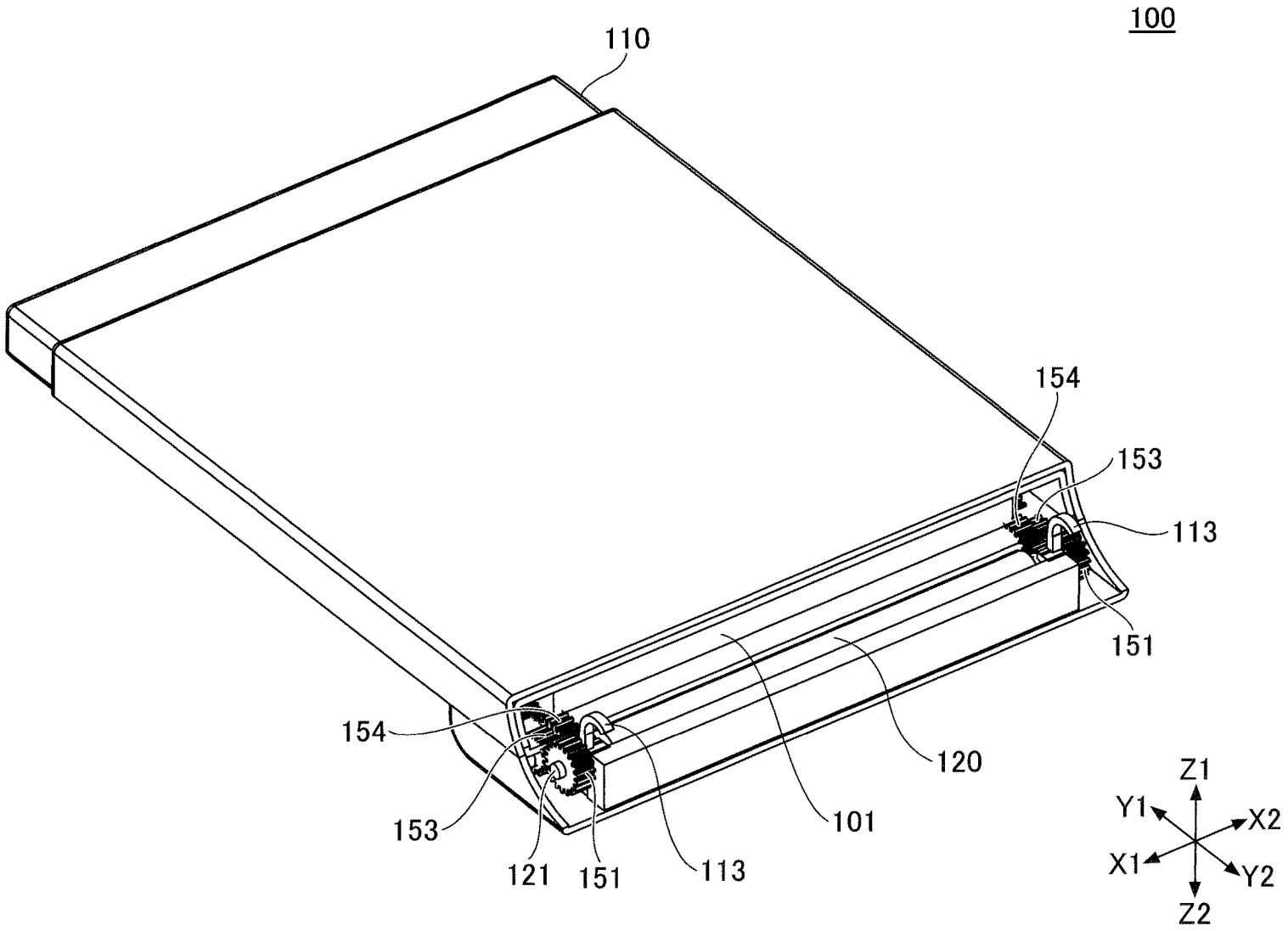
FIG. 5 is an upper perspective view of the sheet cassette of the embodiment.

A sheet cassette 100 of this embodiment is described. The sheet cassette 100 can be attached to the printer 10. FIG. 3 is an upper partly-transparent perspective view of a casing of the sheet cassette 100. FIG. 4 is a bottom partly-transparent perspective view thereof. FIG. 5 is an upper perspective view thereof.

The sheets 101 are stacked and set inside a casing 110 of the sheet cassette 100. A spring 112 is installed on an inner upper surface of the casing 110 so as to push the stacked sheets 101 downward to the Z2 direction. In order to smoothly convey the sheet, a rib 114 extending in the Y direction is provided on the inner upper surface of the casing 110 so as to protrude in the Z2 direction, and a rib 115 extending in the Y direction is provided on the lower surface of the casing 110 so as to protrude in the Z1 direction.

The sheet cassette 100 has two claws 113 on the Y2 side. The claws are provided to install the sheet cassette 100 in the printer 10. By hanging the claws 113 on the shaft of a feed roller 13 of the printer 10, the sheet cassette 100 can be connected with the printer 10. The sheet cassette 100 includes a first roller 120, an auxiliary roller 130, and a second roller 140.

The first roller 120 and the second roller 140 for conveying the sheets rotate in a state where the sheet cassette 100 is connected with the printer 10. Detailed description thereof will be given later.

Figure 6:
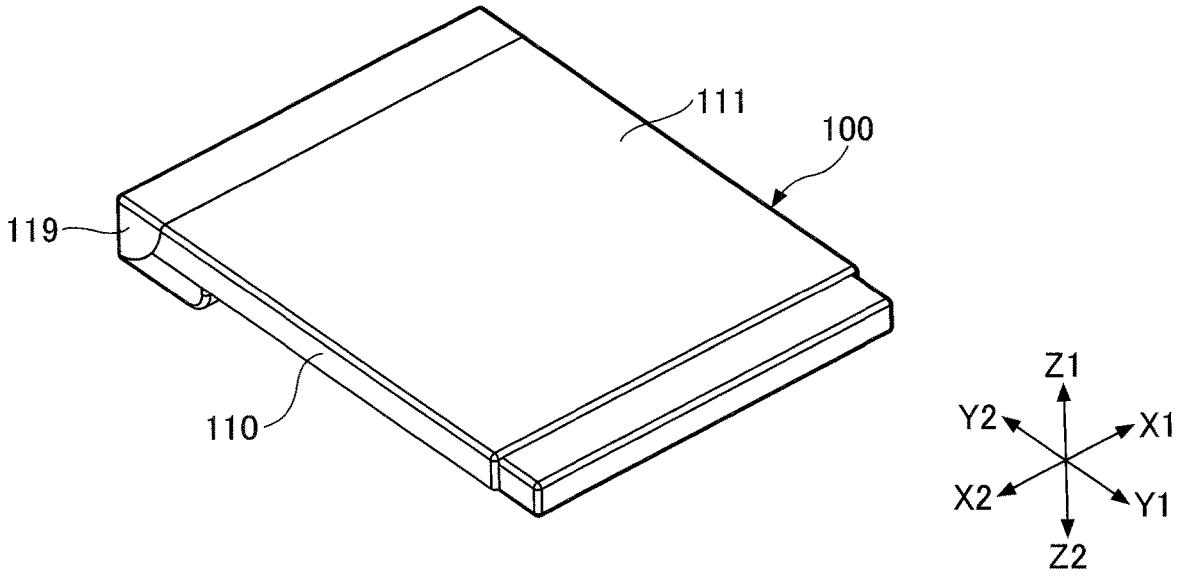
FIG. 6 is an upper perspective view of a sheet cassette to which a cover is attached.
Figure 7:
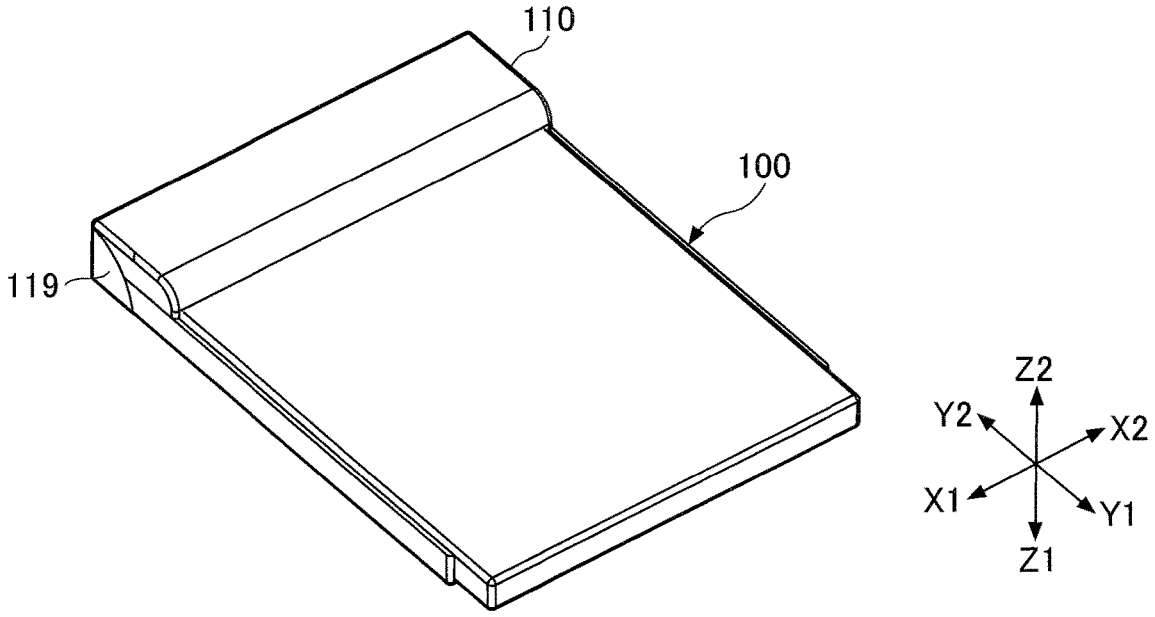
FIG. 7 is a bottom perspective view of the sheet cassette to which the cover is attached.

FIG. 6 is an upper perspective view of the sheet cassette 100, to which a cover 119 is attached. FIG. 7 is a bottom perspective view thereof.

Referring to FIGS. 6-7, the cover 119 may be attached to the sheet cassette 100 to cover the Y2 side of the sheet cassette 100 in a case where the sheet cassette 100 is carried, for example. The claws 113, the first roller 120, and the first gear 151 are covered by the attached cover 119.

(Connection with Printer)

Figure 8:
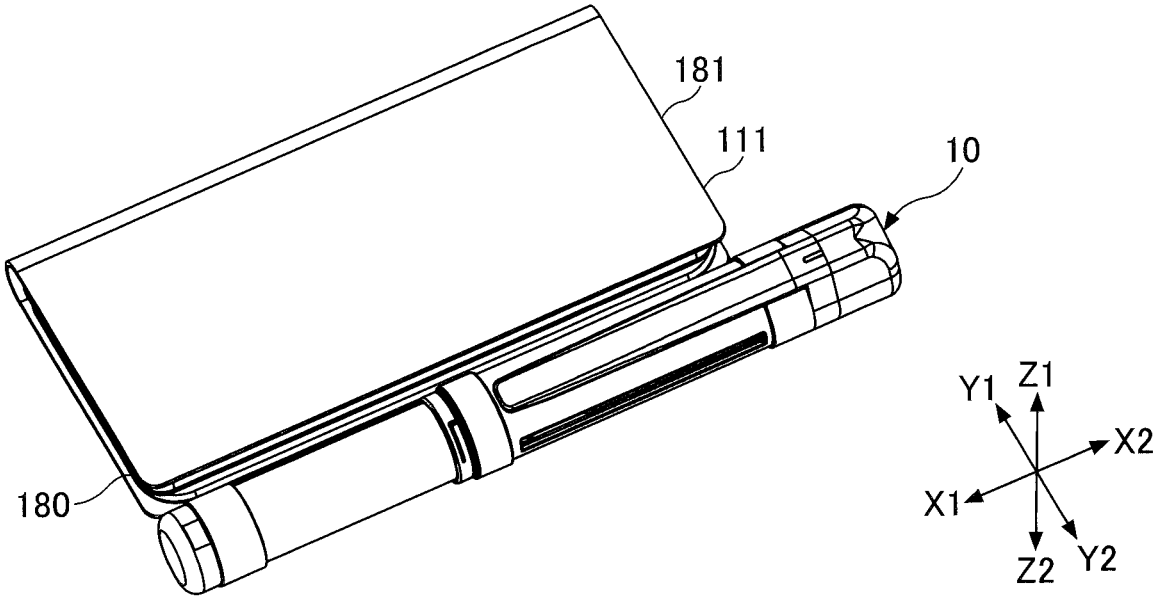
FIG. 8 is an upper perspective view of the sheet cassette to which a printer is attached.
Figure 9:
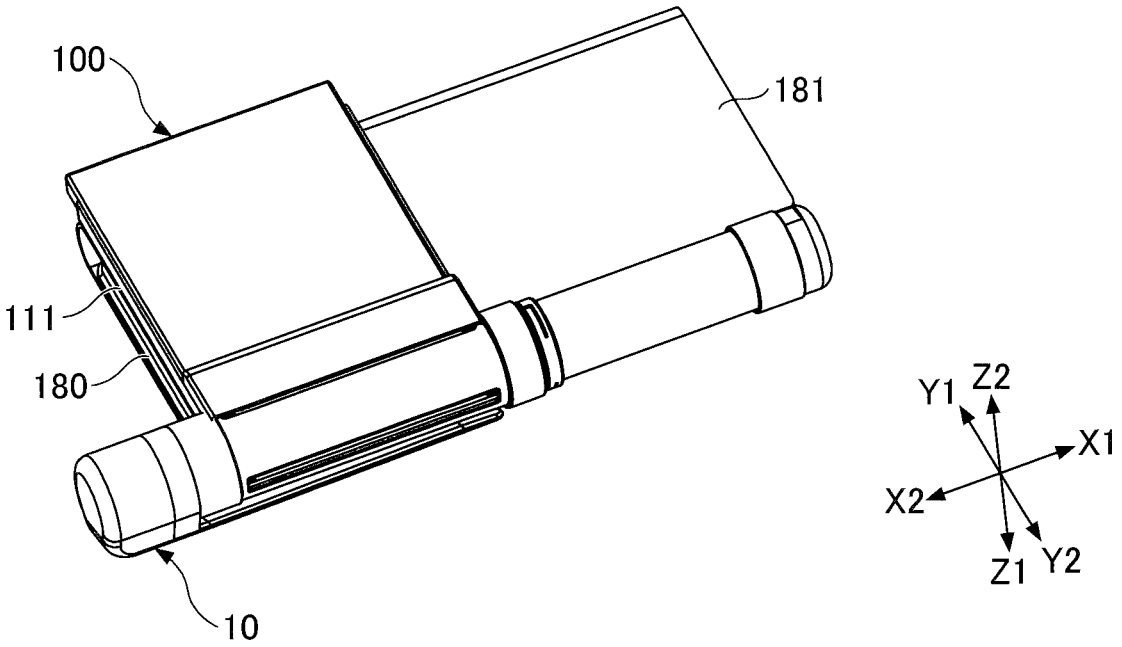
FIG. 9 is a bottom perspective view of the sheet cassette to which the printer is attached.
Figure 10:
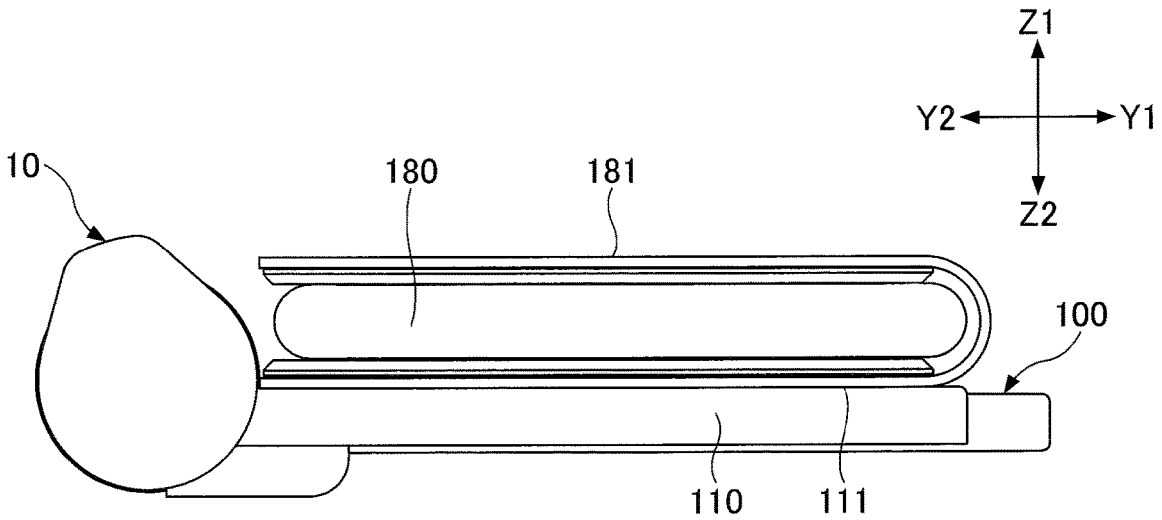
FIG. 10 is a side view of the sheet cassette to which the printer is attached.
Figure 11:
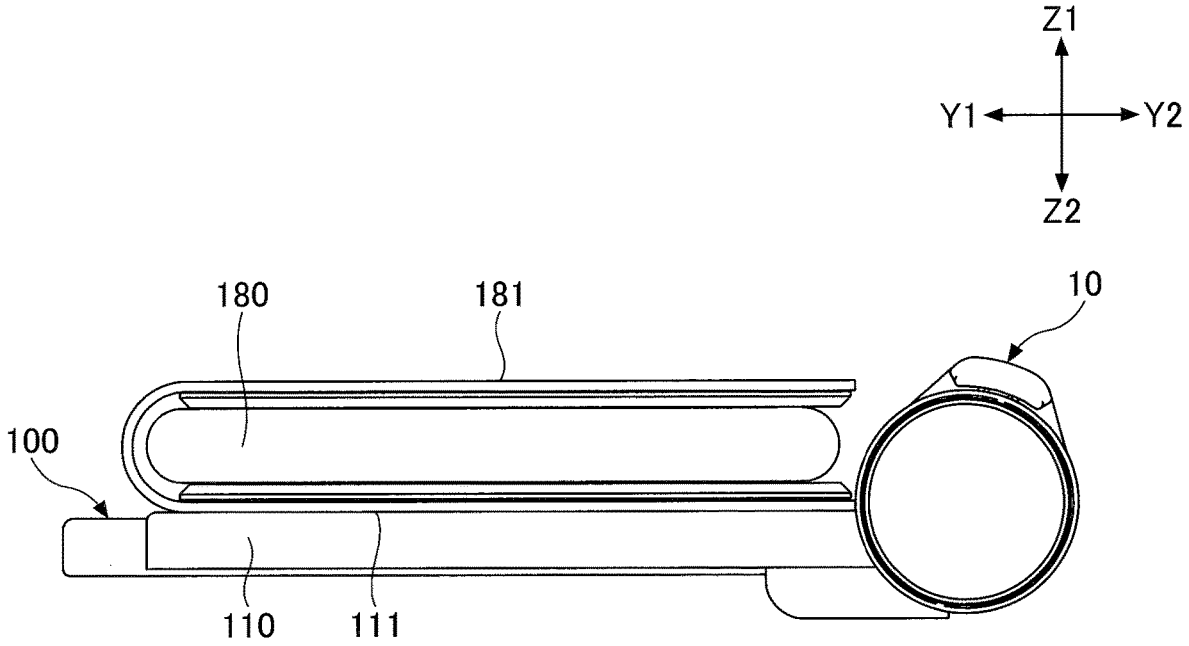
FIG. 11 is a side view of the sheet cassette to which the printer is attached.

The connection between the sheet cassette 100 and the printer 10 is described by referring to FIGS. 8-9. FIG. 8 is an upper perspective view of the sheet cassette 100 attached to the printer 10. FIG. 9 is a bottom perspective view thereof.

As described above, by hooking the claws 113 provided on the Y2 side of the sheet cassette 100 on the shaft of the feed roller 13 of the printer 10, the sheet cassette 100 is connected with the printer 10. Further, in this embodiment, a mobile terminal 180 such as a smartphone may be mounted on the sheet cassette 100. Specifically, as illustrated in FIGS. 8-11, the mobile terminal 180 to which a cover 181 is attached may be mounted on a mounting area 111 of the casing 110.

(Installation of Sheet)

Figure 12:
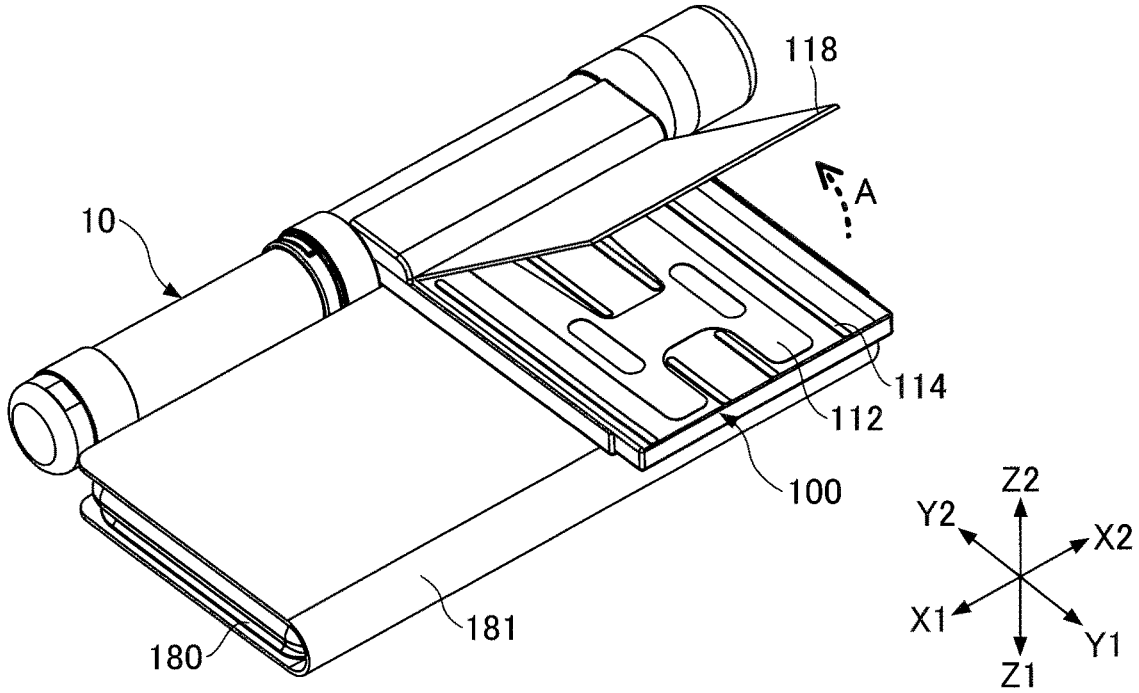
FIG. 12 illustrates a sheet into the sheet cassette of the embodiment.
Figure 13:
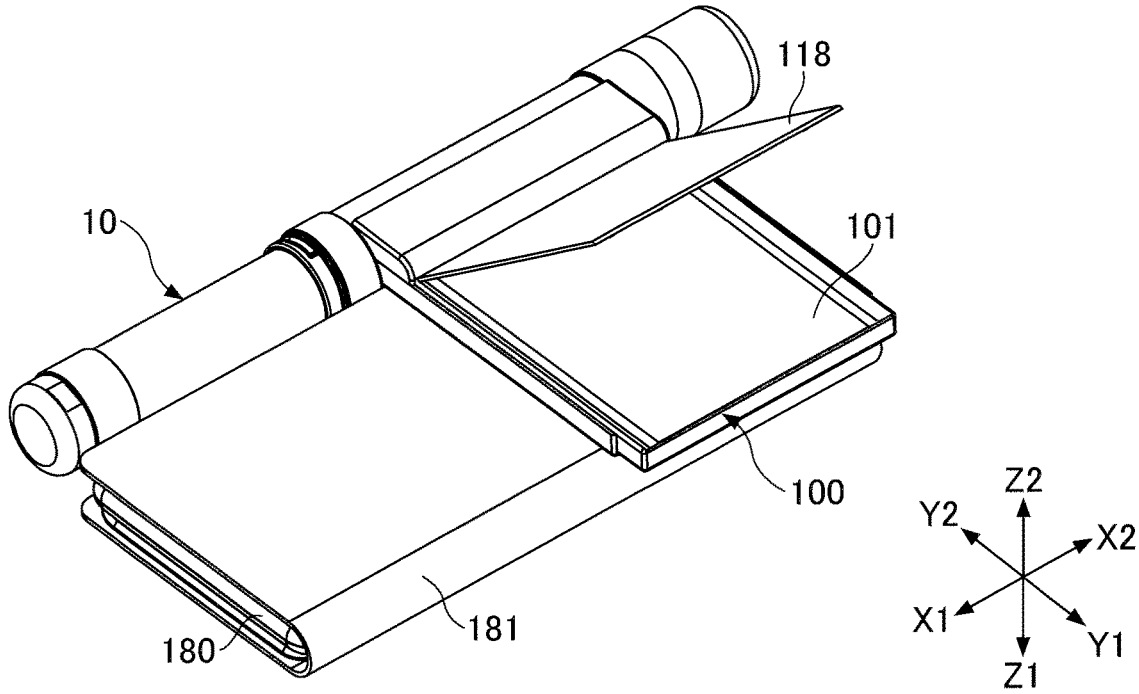
FIG. 13 illustrates a sheet into the sheet cassette of the embodiment.
Figure 14:
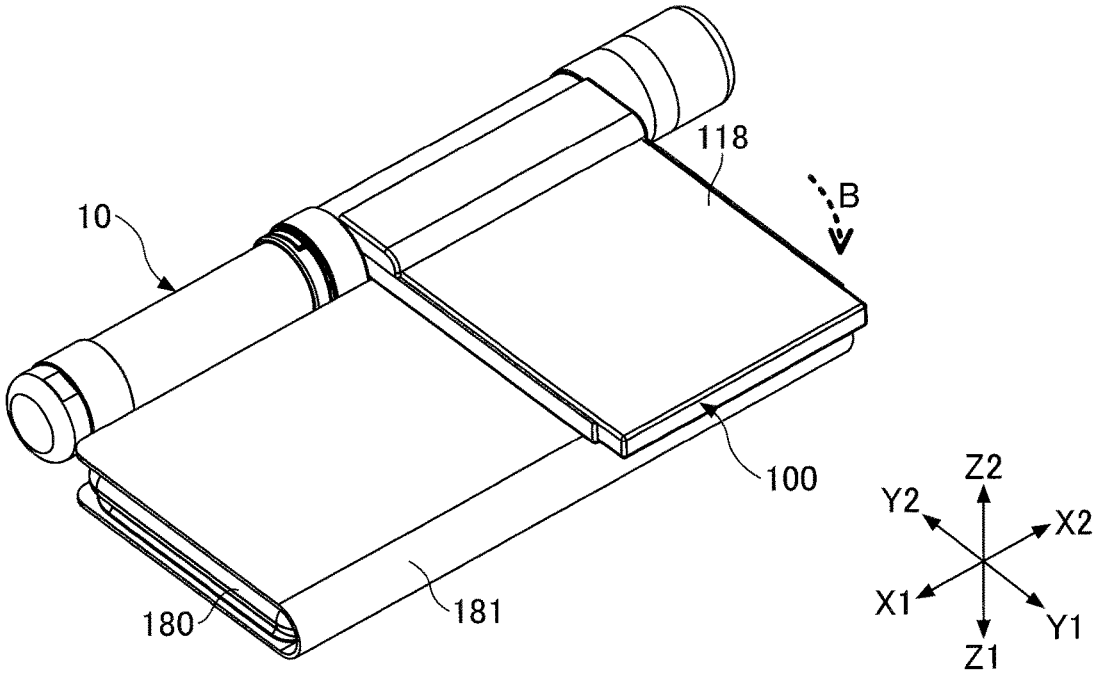
FIG. 14 illustrates a sheet into the sheet cassette of the embodiment.

Installation of the sheets 101 in the sheet cassette 100 is described by referring to FIGS. 12-14.

A lid 118 is provided on the bottom of the sheet cassette 100 that is in the Z2 direction. The lid 118 is rotatable around an axis extending in the X direction. When the sheets 101 are installed in the sheet cassette 100, the lid 118 is rotated as indicated by arrow A in FIG. 12 so as to open. Then, the sheets 101 are set inside the sheet cassette 100. Thereafter, the lid 118 is closed as indicated by arrow B in FIG. 14.

(Sheet Cassette)

A mechanism of the sheet cassette 100 is described by referring to FIGS. 15 to 19.

Figure 15:
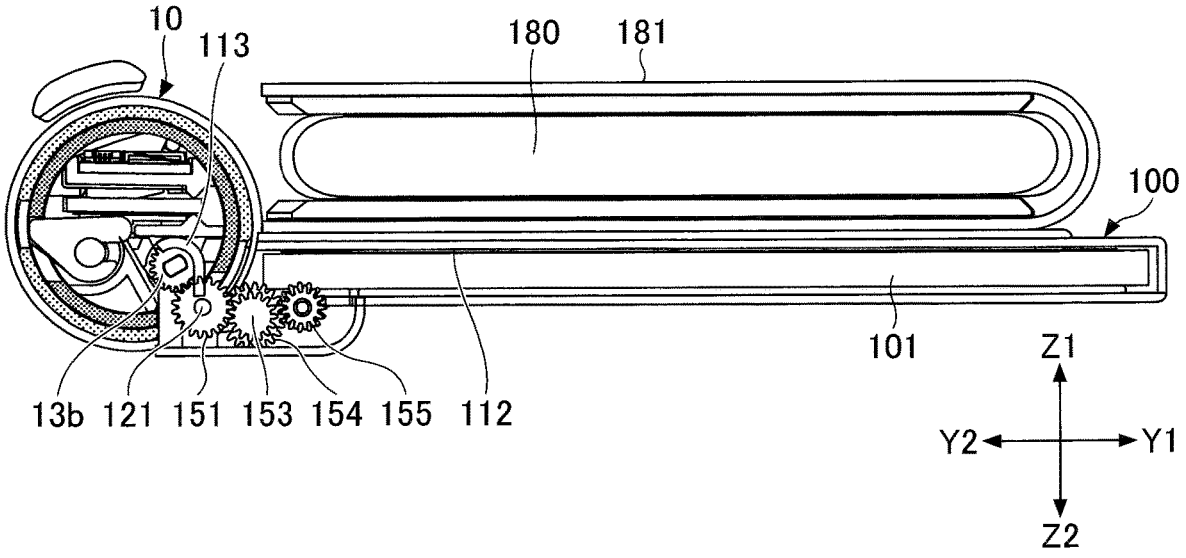
FIG. 15 explains a connection between the sheet cassette and the printer.
Figure 16:
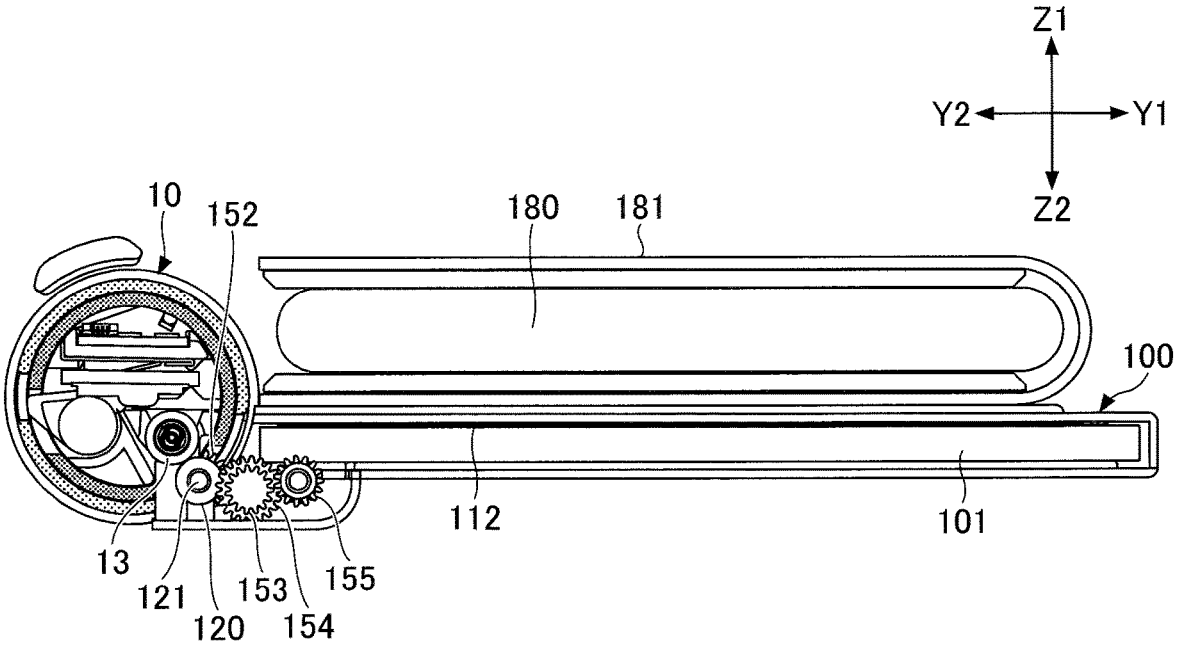
FIG. 16 explains the connection between the sheet cassette and the printer.
Figure 17:
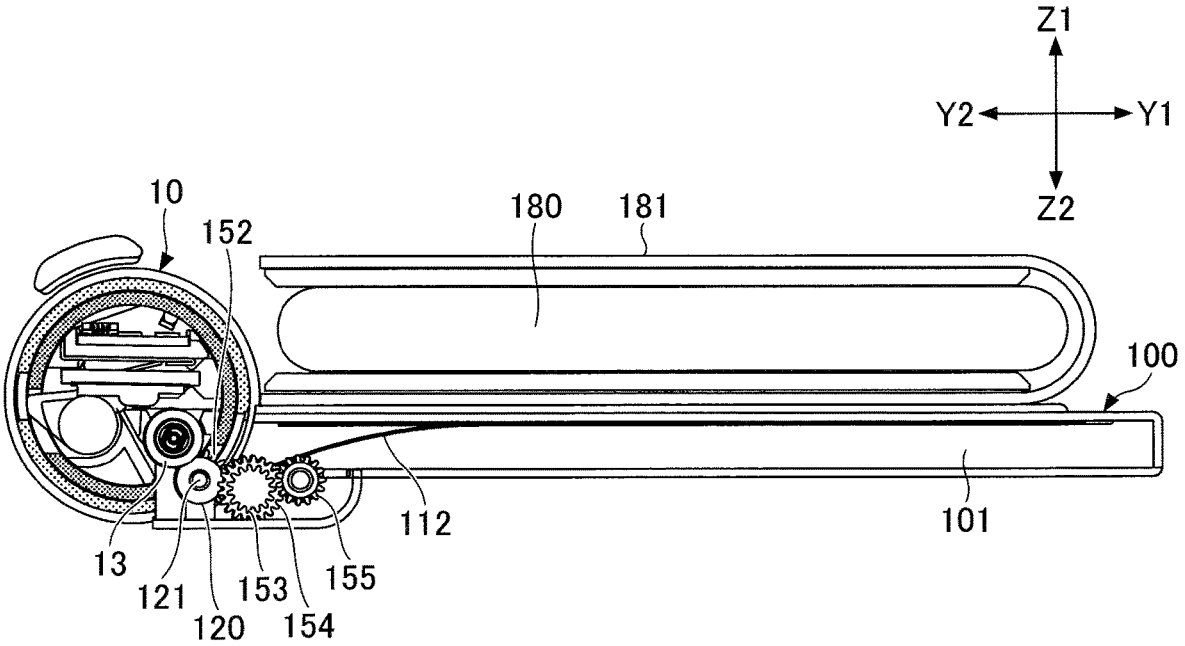
FIG. 17 explains the connection between the sheet cassette and the printer.
Figure 18:
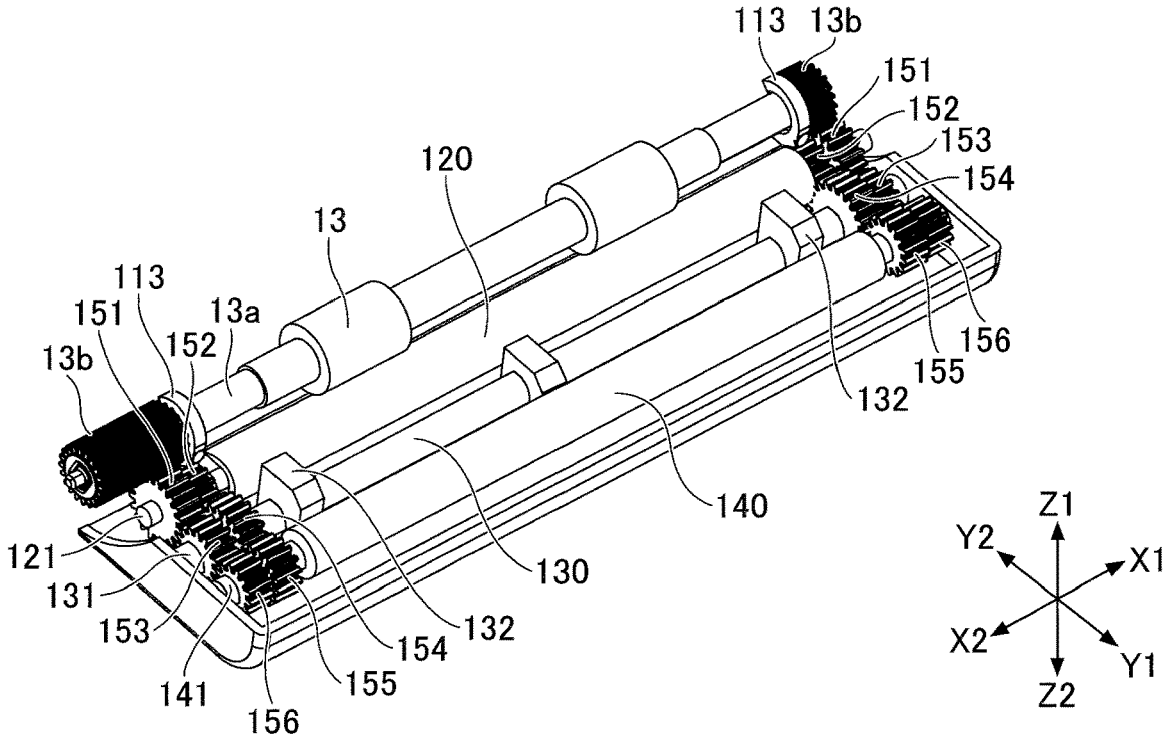
FIG. 18 explains gears of the sheet cassette and the printer.
Figure 19:
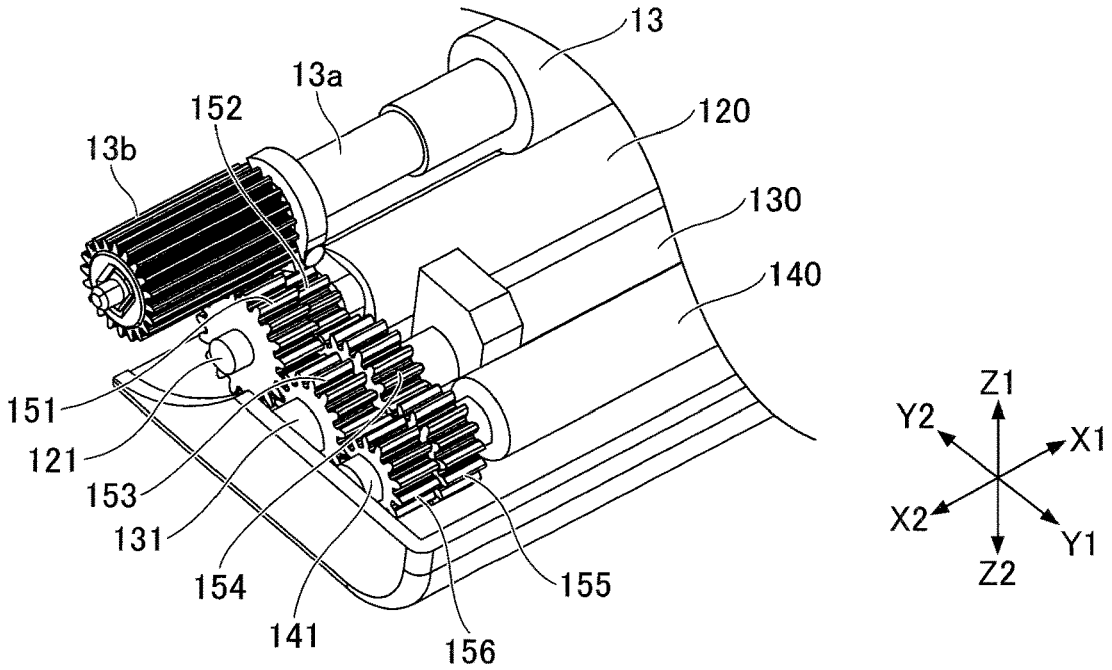
FIG. 19 explains the gears of the sheet cassette and the printer.

FIGS. 15 to 17 are cross-sectional views of the sheet cassette 100 connected with the printer 10 so as to explain engagement of the gears. FIGS. 15 and 16 illustrate a state where the sheets 101 are accommodated inside the sheet cassette 100. FIG. 17 illustrates a state where the sheet 101 is not accommodated inside the sheet cassette 100. FIG. 18 is a perspective view of the feed roller 13 of the printer 10, the first roller 120, the auxiliary roller 130, and the second roller 140 in a condition where the printer 10 is connected with the sheet cassette 100. FIG. 19 is an enlarged view of a portion of FIG. 18. For convenience of explanation, FIGS. 18 and 19 differ from the other figures in detail. However, this difference does not affect the contents of the present invention. For convenience of explanation, the sixth gear 156 is omitted from illustration in FIGS. 15-17.

The feed roller 13 feeds the sheet 101 pulled out from the sheet cassette 100. The feed roller 13 is attached to the shaft 13*a* in a free state where the feed roller 13 is rotatable independent from the shaft 13*a*. The rotation of the feed gears 13*b* attached to the both sides of the shaft 13*a* is not influenced by the rotation of the feed roller 13. The feed gears 13*b* and the shaft 13*a* integrally rotate.

The first roller 120 is attached to the shaft 121 so as to integrally rotate. A set of the first gear 151 and the second gear 152 is attached to each side of the shaft 121. The first gear 151 is attached outside the second gear 152.

The first gear 151 is attached to the shaft 121 in a free state where the first gear 151 is rotatable independent from the shaft 121. The second gear 152 is fixedly attached to the shaft 121 so as to integrally rotate.

The auxiliary roller 130 is attached to a shaft 131. In this embodiment, only the shaft 131 rotates by the rotation of the motor, and the auxiliary roller 130 may freely rotate relative to the shaft 131. As illustrated in FIG. 18, a sheet guide 132 is provided to protrude in the Z1 direction so that the conveyed sheet does not contact the auxiliary roller 130. A set of a third gear 153 and a fourth gear 154 is attached to each side of the shaft 131. The third gear 153 is attached outside the fourth gear 154.

The third gear 153 is fixedly attached to the shaft 131 so as to integrally rotate. The fourth gear 154 may be rotate in only one way and ordinarily rotates together with the third gear 153. When the sheet is conveyed while interposed between the printer head 11 and the platen roller 12, the platen roller 12 is driven at a conveying speed faster than a feed speed of the sheet 101 from the cassette 100 so as to prevent paper slack and an influence caused by the paper slack in printing is canceled. Therefore, if the conveying speed of the sheet 101 becomes faster, the fourth gear 154 rotates faster than the third gear 153 and the shaft 131.

The second roller 140 feeds the sheets from the sheet cassette 100 one by one. The second roller 140 is attached to the shaft 141 so as to integrally rotate. A set of the fifth gear 155 and the sixth gear 156 is attached to each side of the shaft 141. The sixth gear 156 is attached outside the fifth gear 155.

The sixth gear 156 is fixedly attached to the shaft 141 so as to integrally rotate. The fifth gear 155 rotates only in one way and ordinarily rotates together with the sixth gear 156. If the conveying speed of the sheet 101 becomes faster, the second roller 140 rotates at a high speed in association with the conveying speed of the sheet by the platen roller 12, and the rotation of the fifth gear 155 delays by a one-way mechanism that enables to rotate in a single way.

Figure 20:
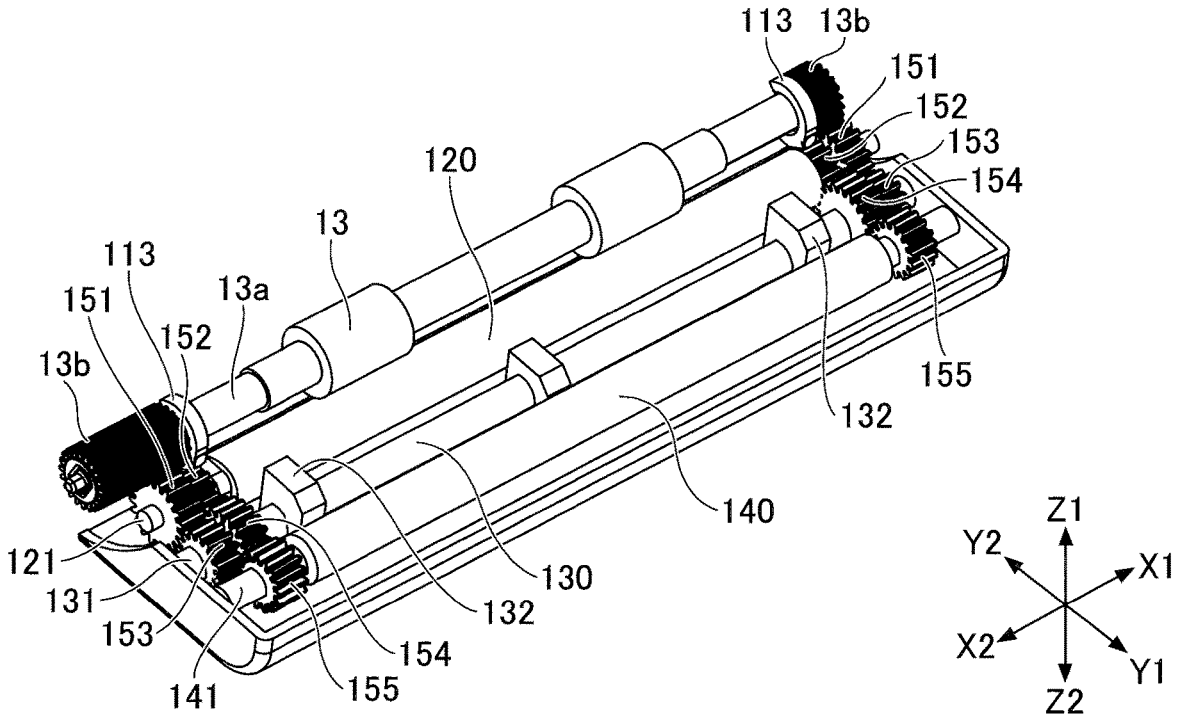
FIG. 20 explains the gears of the sheet cassette the printer.

In this embodiment, the feed gear 13*b* engages with the first gear 151, and the first gear 151 engages with the third gear 153. Further, the fourth gear 154 engages with the second gear 152 and the fifth gear 155. No gear engages with the sixth gear 156. As illustrated in FIG. 20, this embodiment may be structured such that the shaft 141 is not provided with the sixth gear 156. Alternatively, the one-way mechanism of the fifth gear 155 may be provided to the sixth gear 156 or the shaft 141.

The first roller 120 and the second roller 140 are slightly adhesive. A rotary drive side roller is to be preferably slightly adhesive. By adopting the slightly adhesive roller, the sheets 101 can be securely conveyed.

(Conveyance of Sheet)

Conveyance of the sheets 101 in the sheet cassette 100 is described. Referring to FIGS. 15 and 16, the sheet accommodated in the sheet cassette 100 is pushed in the Z2 direction by the biasing force of the spring 112. With this, the lowermost sheet 101 contacts the second roller 140. The printer 10 of the embodiment is a thermal printer having a thermal head as a printer head 11. Therefore, when thermal paper is used as the sheets 101, if force is continuously applied to a printing surface of the thermal paper for a long time, the color of a part of the thermal paper contacting the second roller may change. In this embodiment, it may be possible to suppress the color of the thermal paper from changing because the sheet 101 contacts the second roller 140 at a back surface opposite to the printing surface.

Figure 21:
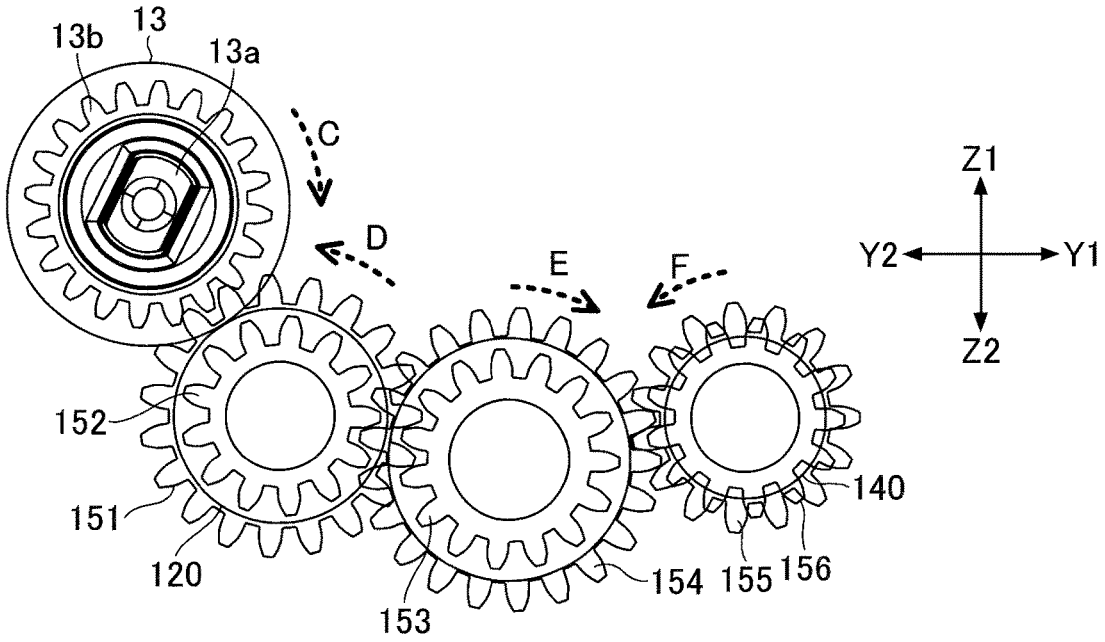
FIG. 21 explains rotation of the gears of the sheet cassette.

When the sheet 101 accommodated in the sheet cassette 100 is to be conveyed, the feed gear 13*b* is rotated in the clockwise direction indicated by arrow C illustrated in FIG. 21. A motor (not illustrated) provided inside the printer 10 is rotated so as to transmit the rotation of the motor to the feed gear 13*b*. When the feed gear 13*b* attached to the shaft 13*a* rotates in the clockwise direction, the shaft 13*a* rotates in the clockwise direction. However, the feed roller 13 does not rotate along with the rotation of the shaft 13*a*.

The first gear 151 engaging with the feed gear 13*b* rotates in the counterclockwise direction indicated by arrow D by the rotation of the feed gear 13*b* in the clockwise direction. Because the first gear 151 is attached to the shaft 121 so as to be independently rotatable relative to the shaft 121, the shaft 121 and the first roller 120 do not rotate by the rotation of the first gear 151.

The third gear 153 engaging with the first gear 151 rotates in the clockwise direction indicated by arrow E when the first gear 151 rotates in the counterclockwise direction. The fourth gear 154 is a one-way gear that rotates only one way, and runs idle relative to the third gear 153 depending on the rotation direction. When the third gear 153 rotates in the clockwise direction, the fourth gear 154 rotates in the clockwise direction in association with the third gear 153.

The fifth gear 155 engaging with the fourth gear 154 rotates in the counterclockwise direction indicated by arrow F when the fourth gear 154 rotates in the clockwise direction. The fifth gear 155 is connected to the second roller 140 through a one-way mechanism. The second roller 140 rotates in the counterclockwise direction in conformity with the rotation of the fifth gear 155 in the counterclockwise direction. When the second roller 140 rotates in the counterclockwise direction, the lowermost sheet 101 in the sheet cassette 100 contacting the second roller 140 is conveyed in the Y2 direction.

The second gear 152 engaging with the fourth gear 154 rotates in the counterclockwise direction indicated by arrow D when the fourth gear 154 rotates in the clockwise direction indicated by the arrow E. The first roller 120 connected to the second gear 152 rotates in the counterclockwise direction along with the rotation of the second gear 152. When the first roller 120 rotates, the feed roller 13 contacting the first roller 120 rotates in the clockwise direction indicated by the arrow C.

With these operations, the sheet 101 conveyed to the vicinity of the first roller 120 is interposed between the first roller 120 and the feed roller 13, and is conveyed into the printer 10 by the counterclockwise rotation of the first roller 120.

The sheet 101 conveyed into the printer 10 is conveyed by the rotating platen roller 12 in a state where the sheet 101 is interposed between the platen roller 12 and the printer head 11.

A case where the sheet 101 is conveyed by the platen roller 12 and printed while the sheet 101 is interposed between the platen roller 12 and the printer head 11 is described.

When the printer 10 starts to print, the conveying speed of the sheet 101 by the platen roller 12 is set to be faster than the conveying speed of the sheet 101 by the first roller 120 so that the conveyed sheet 101 does not slack in the inside of the printer 10. Therefore, if the sheet 101 is interposed between the platen roller 12 and the printer head 11, the recording paper 101 is pulled onto the side of the platen roller 12. Then, the feed roller 13 that can run idle rotates while the contacting sheet 101 is conveyed. Because the rotating speed of the feed roller 13 depends on the conveying speed of the sheet 101, if the conveying speed of the sheet 101 becomes faster by the rotation of the platen roller 12, the feed roller 13 rotates faster than the feed gear 13*b*. If the feed roller 13 rotates faster, the first roller 120 that rotates while contacting the feed roller 13 also rotates faster. As the first roller 120 and the second gear 152 are fixed to the shaft 121 so as to rotate in an interlocked manner, if the rotating speed of the first roller 120 becomes faster, the second gear 152 rotating in the counterclockwise direction interlocked with the first roller 120 also rotates faster.

The fourth gear 154 that engages with the second gear 152 is a one-way gear. When the rotating speed of the second gear 152 becomes faster, the second gear 152 can rotate faster than the third gear 153, and the fourth gear 153 that engages with the second gear 152 also rotates faster than the third gear 153.

The fifth gear 155 engaging with the fourth gear 154 rotates faster in the counterclockwise direction indicated by the arrow F when the fourth gear 154 rotates faster in the counterclockwise direction. As the fifth gear 155 and the second roller 140 are coupled through the one-way mechanism, the second roller 140 does not interlock with the fifth gear 155 when the fifth gear 155 rotates at a high speed, but interlocks with the conveying speed of the recording paper.

When the sheet 101 is pulled, the first roller 120 interlocked with the second gear 152 is pulled by the sheet 101, and the second gear 152 rotates along with the first roller 120 in an interlock manner. Then, the second gear 152 drives to rotate the fourth gear 154.

If the fourth gear 154 is not the one-way gear, the fourth gear 154 rotates the shaft 131, and the third gear 153 rotates. Because the third gear 153 is interlocked with the feed gear 13*b*, the rotation of the third gear 153 may interfere with the rotation of the feed gear 13*b*. Therefore, two one-way gears are provided to avoid such interferences.

If the fifth gear 155 is not the one-way gear, the second gear 152 through the fifth gear 155 rotate respectively at predetermined speeds. Therefore, the feeding speed by the second gear 152 needs to be the same as the feeding speed by the fifth gear 155.

Meanwhile, it may be possible to make the second gear 152 and the third gear 153 the one-way gears, and to make the fifth gear 155 other than the one-way gear. In this case, the sixth gear 156 becomes unnecessary. However, in this case, the feeding speed of the second gear 152 and the feeding speed of the fifth gear 155 are the same, and it is difficult to locate the sheet in front of a sensor while a previously conveyed sheet is extracted. Further, when decreasing the rotating speed of the fifth gear 155, a large tension is always applied between the second gear 152 to the fifth gear 155 so as to give a bad influence to the parts forming the sheet cassette 100. Therefore, it is preferable to provide two one-way gears in such case.

If the conveyed sheet 101 is out of the feed roller 13, the fourth gear 154 is rotated by the second gear 152, the fifth gear 155 is rotated by the fourth gear 154, and further the sixth gear 156 is rotated. Along with this, the second roller 140 rotates to convey a next sheet 101 accommodated in the sheet cassette 100.

Further, the sheet 101 is automatically switched to the next sheet. The printer is designed to give a difference between a draw-in speed and a feeding speed so that the next sheet is positioned before a sheet position detector at a time when the previously conveyed sheet is ejected.

In the embodiment, the one-way mechanism, which is provided to deal with a case where the conveying speed of the sheet 101 becomes faster after starting conveying the sheet 101 by the platen roller 12, is installed not in the printer 10 but in the sheet cassette 100. If the one-way mechanism is provided to the printer, the length of the printer 10 increases about 5 mm to 10 mm so as to be a larger size. In this embodiment, because the one-way mechanism is installed in the sheet cassette 100, the printer 10 can be made smaller and lighter than a printer with the one-way mechanism.

In the embodiment, a power source of the first roller 120 and the second roller 140 is a motor provided to the printer 10. By rotating the feed gear 13*b* by the motor provided to the printer 10 to rotate the first gear 151 engaging with the feed gear 13*b*, the other gears are driven to rotate the first roller 120 and the second roller 140. Because the motor for rotating the first roller 120 and the second roller 140 is not provided to the sheet cassette 100, the sheet cassette 100 can be made small and light.

Further, the sheet cassette of the present embodiment may have a rechargeable battery so as to supply electric power to the printer.

According to the disclosed sheet cassette, a printer connectable to the sheet cassette can be made small.

Although the one or more embodiments of the present invention have been described heretofore, the present invention is not limited to these embodiments, and various variations and modifications may be made without departing from the scope of the present invention.

What is claimed is:

1. A sheet cassette that accommodates a recording sheet and is connectable to a printer, the sheet cassette comprises:

a first roller that contacts a feed roller of the printer;

a second roller that contacts a recording sheet;

a first gear and a second gear that are attached to a shaft of the first roller;

a third gear and a fourth gear that are attached to a single shaft; and a fifth gear that is attached to a shaft of the second roller, wherein the first gear independently rotates relative to the first roller and the second gear, the first gear engages with the third gear, the fourth gear rotates together with the third gear, the fourth gear engage with the fifth gear, and the second roller is rotated by rotation of the fifth gear, and when the sheet cassette is connected with the printer, the first gear engages with a feed gear of the printer.

2. The sheet cassette according to claim 1, wherein rotation of the feed gear is transmitted to the first gear, the rotation of the first gear is transmitted to the third gear, the fourth gear rotates along with the third gear rotation of the fourth gear is transmitted to the fifth gear, and by the rotation of the fifth gear, the recording sheet contacting the second roller is conveyed onto a printer side.

3. The sheet cassette according to claim 1, wherein the fourth gear engages with the second gear, rotation of the fourth gear is transmitted to the second gear, the first roller rotates by rotation of the second gear, and by the rotation of the first roller, the feed roller contacting the first roller rotates, and the recording sheet interposed between the first roller and the feed roller is conveyed.

4. The sheet cassette according to claim 1, wherein the fourth gear is a one-way gear that rotates in a single way.

5. The sheet cassette according to claim 4, wherein a shaft of the second roller has a one-way mechanism that rotates in a single way.

6. The sheet cassette according to claim 4, wherein the second gear rotates by rotation of the first roller when the printer prints, and rotation of the second gear is transmitted to the fourth gear and the fourth gear rotates faster than the third gear.

* * * * *